United States Patent [19]

Durí

[11] Patent Number: 4,644,773

[45] Date of Patent: Feb. 24, 1987

[54] CONVERTIBLE HEAD TO FORM COILS

[75] Inventor: Antonino Durí, Pradamano, Italy

[73] Assignee: Danieli & C. Officine Meccaniche SpA, Buttrio, Italy

[21] Appl. No.: 772,480

[22] Filed: Sep. 4, 1985

[30] Foreign Application Priority Data

Sep. 19, 1984 [IT] Italy ..... 60459/84[U]

[51] Int. Cl.[4] ..... B21F 3/04; B21B 43/00

[52] U.S. Cl. ..... 72/135; 72/142; 72/201; 140/2; 266/106

[58] Field of Search ..... 72/135, 142, 201, 371; 140/2; 242/81, 82; 266/106

[56] References Cited

U.S. PATENT DOCUMENTS

| | | | |
|---|---|---|---|
| 429,512 | 6/1890 | Edenborn | 242/82 |
| 3,469,429 | 9/1969 | Dopper et al. | 72/142 X |
| 3,478,408 | 11/1969 | Brown | 72/142 X |
| 4,223,422 | 9/1980 | Weber | 242/82 X |
| 4,320,646 | 3/1982 | Bindernagel et al. | 266/106 X |
| 4,362,040 | 12/1982 | Yamaguchi et al. | 266/106 X |

FOREIGN PATENT DOCUMENTS

| | | | |
|---|---|---|---|
| 714947 | 8/1965 | Canada | 242/81 |
| 1452343 | 2/1969 | Fed. Rep. of Germany | 140/2 |

*Primary Examiner*—E. Michael Combs
*Attorney, Agent, or Firm*—Wegner & Bretschneider

[57] ABSTRACT

Convertible head (10) to form coils for the forming of coils of rolled wire rod, which comprises a body (11) supported on a tiltable base (18), motor means (12) and rotor means (15–16) and in which the rotor means (15–16) include interchangeable rotors (15–16), of which at least one (15) is suitable to deposit horizontal coils (23), and at least one other (16) is suitable to deposit vertical coils (24).

5 Claims, 3 Drawing Figures

CONVERTIBLE HEAD TO FORM COILS

This invention concerns a convertible head to form coils. To be more exact, the invention concerns a head to form coils which is suitable for forming coils of rolled metallic wire rod.

This head can be converted for use in forming coils arranged horizontally on a cooling conveyor or coils formed and positioned substantially vertically.

The coil-forming head of the invention can be adapted for employment either with cooling conveyors able to carry coils arranged horizontally or with conveyors, chain or belt conveyors for instance, which can transport coils positioned vertically. In particular, in the latter solution the coils are formed with the help of a drawing means that is a part of the rotor of the coil-forming head.

In fact, the invention is intended in particular to obtain substantially vertical coils consisting of round bars of a large diameter (as an indication, from 12–15 mm. to 30–35 mm. or greater).

Normal heads to form coils are known and various types of them already exist in the art; all of such heads comprise an inlet conduit for the rolled rod, which is perhaps guided by a drawing unit located upstream of the head, and also a rotary headstock or rotor. Such rotor is driven by suitable motor means and, as is known, forms the coils.

When formed, the coils fall onto a cooling conveyor and are transported thereon and undergo a controlled cooling at the same time.

As is well known, wound bundles are formed with such coils at the end of the conveyor line.

A method is also known for the formation of coils arranged vertically. In this case the coils are borne in succession along the cooling conveyor, being positioned vertically and substantially parallel to each other; in this case too the coils are gathered in wound bundles at the end of the cooling conveyor.

For instance, patent No. GB-A-1,175,403 (Schloemann) is known and discloses a coil forming head of the "Edenborn" type with a horizontal axis. The coils in every case are formed vertically and always advance in a vertical position before being laid in a collecting vessel for the formation of bundles. The invention lies mainly in the fact that a worm thread is provided at the outlet of the tube laying the filiform material and serves to form the individual coils.

U.S. Pat. No. 3,720,544 (Entringer) discloses the cooling treatment of coils of wire rod laid on a cooling conveyor. The coils are treated within an enclosure arranged appropriately so as to correspond with the controlled cooling conveyor. The coil forming headstock, described diagrammatically, is of a stationary type and forms the coils in a vertical plane. The coils are then laid horizontally on the cooling conveyor in a known manner.

U.S. Pat. No. 1,624,000 (Honig) discloses a device equipped with a coil forming headstock having a vertical axis so as to lay horizontal coils on cores. Bundles are formed in this way and are removed from time to time by means of a rotary table or like means.

DE-B-2.041.875 (Kocks) discloses a coil forming headstock which possesses the feature of being capable of being oriented about a horizontal axis so as to vary the inclination at which the coils are laid. An interchangeable headstock is not included.

DE-B-1.240.025 (Schloemann) is also known. A first embodiment of this invention discloses a vessel to form bundles which is linked to a coil forming headstock coaxial with such vessel and having a vertical axis. The coils are formed horizontally and laid so as to form a bundle directly in the vessel. Force draft cooling means are included. Another embodiment discloses an installation in which the coils are formed vertically by a coil forming headstock with a horizontal axis (Edenborn type). The coils move in a vertical position into a force draft cooling tunnel and are then turned by 90° for collection in a cooling vessel which is not shown.

It is a purpose of this invention to provide a head to form coils which is suitable for use either in forming coils arranged horizontally on a cooling conveyor or in forming coils positioned vertically. The latter method of forming coils is particularly suitable for use with wire rod of a large diameter.

The coil-forming head of the invention will advantageously be convertible. In fact, two types of rotor can be fitted to the coil-forming head, one of them being suitable to form coils which fall, horizontally arranged, on the cooling conveyor, whereas the other type is suitable to form coils positioned substantially vertically and will be employed preferably with wire rod of large diameters.

Such latter rotor for use with large diameters comprises also drawing means arranged peripherally, which have the purpose of imparting a drawing action to the rolled rod so as to enable it to be extracted from the coil-forming head itself.

In fact, the excessive stiffness of rolled rods of a large section does not permit them to be deposited by a normal coil-forming head.

For each type of rotor (for vertical or horizontal coils respectively) there may be a set of two or more rotors suitable for various diameters.

According to the invention the coil-forming head is advantageously capable of being tilted.

In its horizontal position the coil-forming head will be suitable for arranging vertical coils with the help of the drawing means forming part of the type of rotor suited for use with large-diameter rod.

When the head is tilted downwards, it can be used with the type of rotor for horizontal coils in the formation and immediate depositing of coils horizontally on the cooling conveyor. According to the invention the coil-forming head can cooperate with an initial tilted segment of the cooling conveyor when the coils have to be deposited horizontally.

The invention is therefore embodied with a convertible head to form coils of rods, which comprises a body supported on a tiltable base, motor means and rotor means and is characterized in that the rotor means include interchangeable rotors, of which at least one is suitable to deposit horizontal coils on a cooling conveyor, and at least one other is suitable to deposit vertical coils.

We shall describe hereinafter a preferred embodiment of the invention as a non-restrictive example with the help of the attached figures, in which.

Figure 2:
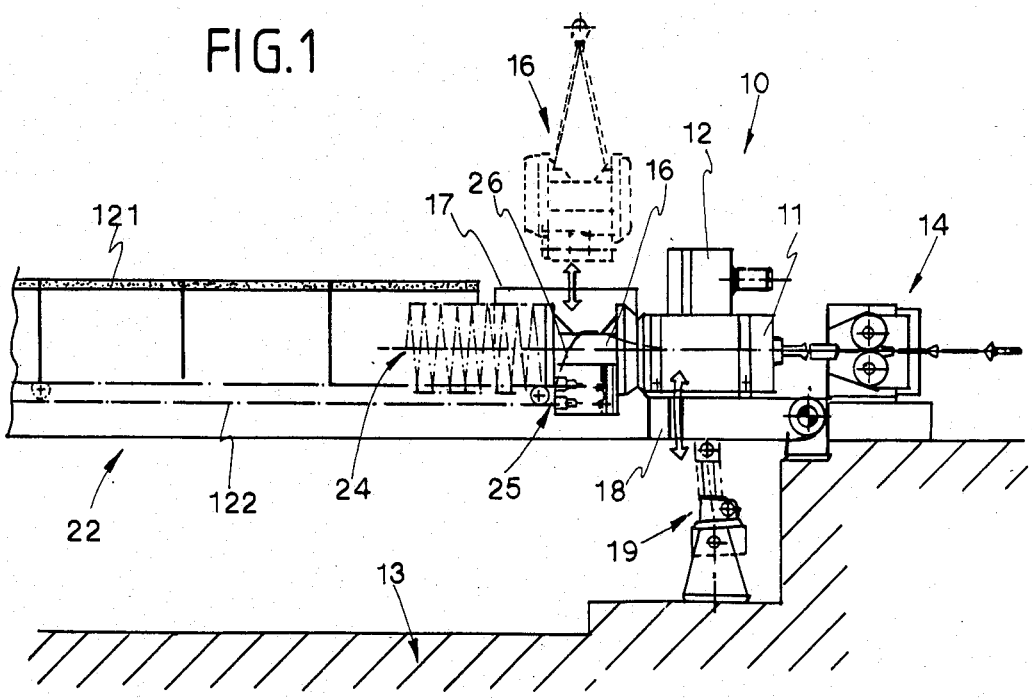
FIG. 2 shows a coil-forming head according to the invention when used to form vertical coils.
Figure 3:
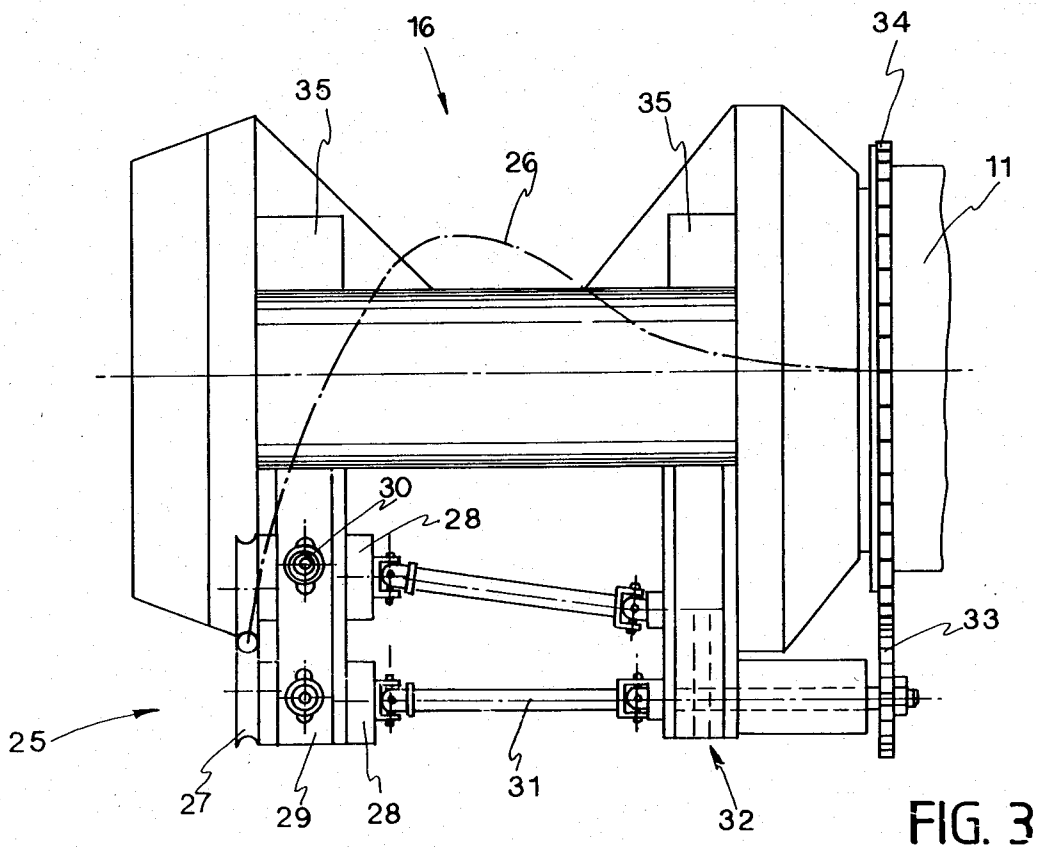

FIG. 3 lastly shows a detail of a rotor fitted to the coil-forming head of FIG. 2.

In the figures a head 10 to form coils according to the invention comprises a body 11, which is known in itself, together with a motor 12. The whole is positioned immediately downstream of a feeder unit 14 containing rollers to feed the rolled rod, which runs in the direction shown with an arrow.

Figure 1:
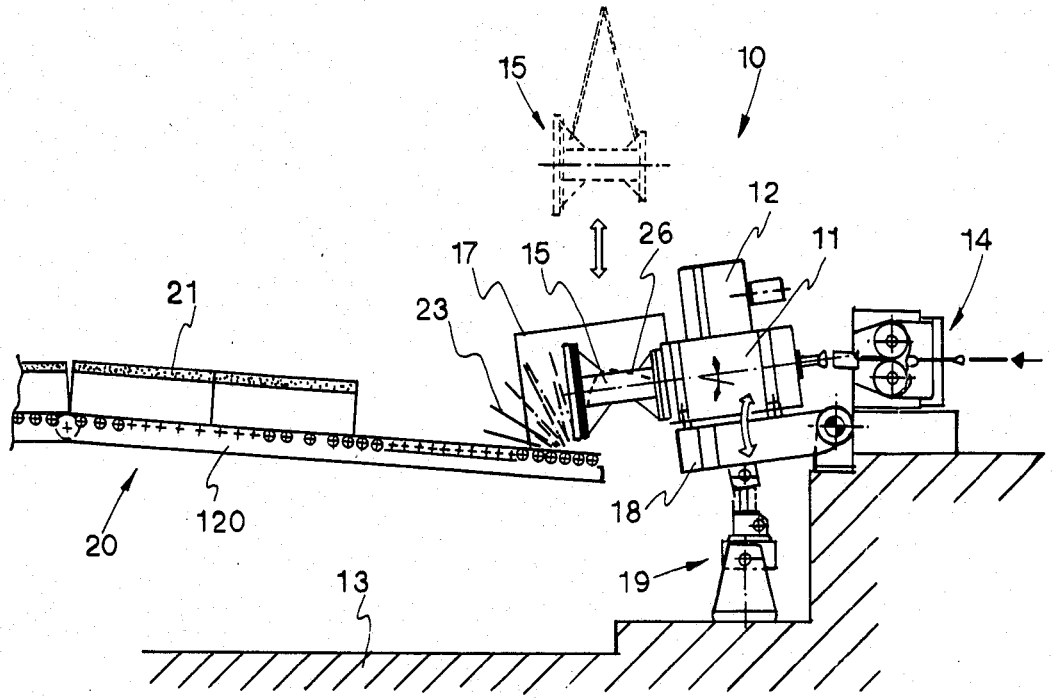
FIG. 1 shows a coil-forming head according to the invention when used to form horizontal coils.

A rotor 15 for horizontal coils is fitted to the body 11 in the example of FIG. 1 and can be detached from the body 11, being coupled to the same in a known manner, for instance with a rapid coupling or screw coupling or a fixed joint or a coupling of another type.

In this example it is possible to see the path of a rolled rod 26, which enters from the feeder unit 14 and runs through the body 11 axially. The rod 26 then forms a loop in correspondence with the rotor 15, and coils 23 are formed and drop, arranged substantially horizontally, onto a cooling conveyor 20.

In fact, the example of FIG. 1 shows coils 23 being deposited substantially horizontally. For this purpose the coil-forming head 10 is tilted, being supported on a tiltable base 18 moved by actuator means 19, which are of a known type such as jack means, screw-threaded means or another equivalent type known in the art.

The actuator means 19 and tiltable base 18 and also the feeder unit 14 are supported by foundations 13 shown in the figure.

The rotor 15 can possibly be arranged in cooperation with a protective screen 17 suitable for preventing any protrusion of the rod 26 outside the rotor 15.

So as to enable the coils to be deposited, the cooling conveyor 20 shown comprises a first tiltable portion 120. The slope of this portion 120 is coordinated with the slope applied to the coil-forming head 10.

Such slope can be about 5°–6° or even more, whereas the tilting of the head 10 can vary from a minimum of 5°–6° up to 12°–15° so as to obtain the method of depositing coils 23 shown in the figure.

FIG. 1 shows also hoods 21 able to provide controlled cooling of the coils 23 by means of known methods. The conveyor 20 may comprise means to blow air which are not shown here. In any event it is to be understood that the coil-forming head 10 of this invention can be fitted to any type of plant performing the controlled cooling of coils of wire rod.

FIG. 2 shows a coil-forming head 10 to which is fitted a rotor 16 for rods of a large diameter. Unlike the rotor 15, this rotor 16 comprises drawing means 25, which are shown better in FIG. 3.

These drawing means, or drawing unit, 25 comprise rollers 27 able to exert on the rolled rod 26 a drawing action which accompanies the rotation of the rotor 16. It is possible in this way to obtain the feed and formation of coils 24 with rolled rod of a large diameter. By large diameter we mean here a diameter ranging from 12–15 mm. to 30–35 mm. or more.

As can be seen in FIGS. 1 and 2, the rotors 15–16 are interchangeable and have the same type of attachment for cooperation with the body 11 of the coil-forming head 10.

For instance, two sets of rotors may be included, one set of two or more rotors for horizontal coils, such rotors being suitable for various diameters of rod, and one set of two or more rotors for vertical coils, such rotors too being suitable for various diameters of rod.

Such replacement is extremely simple when changing from the laying of coils 23 horizontally, as in FIG. 1, to the laying of coils 24 vertically, as in FIG. 2.

The rotors 15–16 are equipped advantageously with eyelets or like attachments for handling with hooks, cables or chains of a crane or bridge crane, as shown with dotted lines in FIGS. 1 and 2.

In FIG. 2 the coil-forming head 10 is shown cooperating with a conveyor or cooling conveyor belt 22 which comprises chains 122. Such chains 122 have the task of supporting and conveying the vertical coils 24 along the conveyor 22 according to a method known in the art.

In this case too cooling hoods 121 are included which have a height sufficient to accommodate the vertically positioned coils 24; the working position of the coil-forming head 10 in this case is horizontal.

FIG. 3 gives in greater detail a side view of a preferred embodiment of a rotor 16 of a type suitable to form vertical coils, preferably of rod of a large diameter.

It is possible to see the path of the rolled rod 26, which passes through the body 11, reaches the rotor 16 and is made to pass between two drawing rollers 27 of the drawing unit 25.

These drawing rollers 27, which may be shaped suitably to engage the rolled rod 26 more securely, are sustained by support 28, which in this example are solidly fixed to a bracket 29 of the rotor 16.

Such supports 28 will be adjustable advantageously and preferably in a direction radial to the rotor 16 to suit the diameter of the coils which are to be obtained and possibly to suit the diameter of the rod 26. In FIG. 3 means 30 to adjust the radial position of the rollers 27 are shown and are locking screw means in this case, but adjustment means of any equivalent type can be provided instead.

The rollers 27 are driven here through universal joints 31, which make possible such adjustment of the radial position of the supports 28 and therefore of the rollers 27.

The universal joints 31 form the end of a motion-output unit 32, which rotates together with the rotor 16 and is driven by a motion take-off wheel 33. The latter gets its motion by cooperating with a fixed toothed wheel 34 solidly fixed to the front portion of the body 11 of the coil-forming head 10.

In this way, when the rotor 16 rotates, the wheel 33 is set in rotation and, through the motion-output unit 32 and universal joints 31, causes rotation of the rollers 27 and therefore the drawing of the rolled rod 26.

FIG. 3 also shows counterweights 35 which serve to counter-balance the masses corresponding to the drawing unit 25.

We have described here a preferred embodiment of the invention but many variants are possible. Thus, for instance, it is possible to provide actuation of the drawing rollers 27 by means of an independent motor fitted to the rotor 16 or by means of a motion take-off system of a type other than that shown.

It is possible to arrange a different conformation or dimensioning of the parts and to provide means of any known type to connect the rotor 15 or 16 to the body 11.

It is also possible to provide more than one drawing unit 25 and to arrange means 30 to adjust the position of the rollers 27 of any required type; these and other variants are all possible for a person skilled in this field without departing thereby from the scope of the invention.

INDEX

10—head to form coils
11—body
12—motor
13—foundations
14—feeder unit
15—rotor for horizontal coils
16—rotor for rods of large diameter
17—screen
18—tiltable base
19—actuator means
20—cooling conveyor belt
120—tiltable portion
21—hoods
121—hoods
22—conveyor or conveyor belt
122—chains
23—horizontal coils
24—vertical coils
25—drawing means
26—rolled rod
27—drawing rollers
28—supports
29—bracket
30—adjustment means
31—universal joints
32—motion-output unit
33—motion take-off wheel
34—fixed toothed wheel
35—counterweights.

I claim:

1. A convertible head to form coils of rod, comprising a tiltable base;

a body supported on said tiltable base;

motor means for rotating said body;

rotor means including a set of interchangeable rotors, wherein at least one of said rotors is structured for forming and depositing horizontal coils and at least one of said rotors is structured for forming and depositing vertical coils;

converyor means;

coupling means on said body for selectively and detachably securing either of said rotors on said body to alternatively form and then deposit either horizontal or vertical coils on said conveyor means.

2. The convertible head of claim 1 wherein said rotor for the forming and deposition of vertical coils includes at least one driven drawing unit for engaging and pulling said rod onto said rotor.

3. The convertible head of claim 2 wherein said drawing unit comprises adjustably positioned rollers for engaging and pulling said rod.

4. The convertible head of claim 2 wherein said drawing unit further includes drive means comprising a motion take-off gear wheel mounted on said rotor, said rotor and said motion take-off gear wheel being mechanically connected to a gear wheel fixed on said body.

5. The convertible head of claim 3 wherein said drawing unit further includes drive means comprising a motion take-off gear wheel mounted on said rotor, said rotor and said motion take-off gear wheel being mechanically connected to a gear wheel fixed on said body.

* * * * *